US009024827B2

(12) United States Patent
Nakano

(10) Patent No.: US 9,024,827 B2
(45) Date of Patent: May 5, 2015

(54) ANTENNA APPARATUS AND COMMUNICATION TERMINAL

(71) Applicant: Murata Manufacturing Co., Ltd., Nagaokakyo-shi, Kyoto-fu (JP)

(72) Inventor: Shinichi Nakano, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/547,381

(22) Filed: Nov. 19, 2014

(65) Prior Publication Data

US 2015/0070224 A1 Mar. 12, 2015

Related U.S. Application Data

(63) Continuation of application No. 13/570,521, filed on Aug. 9, 2012, now Pat. No. 8,922,438.

(30) Foreign Application Priority Data

Aug. 10, 2011 (JP) ..... 2011-174490
Jun. 1, 2012 (JP) ..... 2012-126395

(51) Int. Cl.
*H01Q 1/24* (2006.01)
*H01Q 1/22* (2006.01)
*H01Q 7/00* (2006.01)

(52) U.S. Cl.
CPC ..... *H01Q 1/2208* (2013.01); *H01Q 7/00* (2013.01)

(58) Field of Classification Search
CPC ..... H01Q 1/22; H01Q 1/2208; H01Q 1/2225; H01Q 1/24; H01Q 1/241; H01Q 1/242; H01Q 1/243; H01Q 1/48
USPC ..... 343/702, 767, 848
See application file for complete search history.

(56) References Cited

U.S. PATENT DOCUMENTS

2012/0176282 A1* 7/2012 Kato et al. ..... 343/702
2012/0306714 A1* 12/2012 Yosui et al. ..... 343/788

FOREIGN PATENT DOCUMENTS

WO WO 2010/122685 * 10/2010 ..... H01Q 7/00

OTHER PUBLICATIONS

Nakano, "Antenna Apparatus and Communication Terminal", U.S. Appl. No. 13/570,521, filed Aug. 9, 2012.

* cited by examiner

*Primary Examiner* — Hoang V Nguyen
(74) *Attorney, Agent, or Firm* — Keating & Bennett, LLP

(57) ABSTRACT

In an antenna apparatus, on an undersurface of a metal cover, a feeding coil module is disposed. In a casing, a printed circuit board is included. A ground conductor, a feeding pin, and a ground connection conductor are disposed on the printed circuit board. When the metal cover is mounted on the casing, the feeding pin is in contact with a connection portion of the feeding coil module and is electrically connected thereto. The ground connection conductor is in contact with the metal cover and connects the metal cover to the ground conductor. The ground connection conductor is disposed at either side of a slit outside an area in which the current density of an induced current flowing through the metal cover is in a range from a maximum value to approximately 80% of the maximum value or one side of the slit in the area.

7 Claims, 20 Drawing Sheets

ANTENNA APPARATUS AND COMMUNICATION TERMINAL

BACKGROUND OF THE INVENTION

1. Field of the Invention

The present invention relates to an antenna apparatus preferably for use in short-range communication and a communication terminal including the antenna apparatus.

2. Description of the Related Art

Radio frequency identification (RFID) systems are increasingly becoming popular as product management systems and billing and toll collection management systems. In such an RFID system, a reader/writer and an RFID tag wirelessly communicate with each other to exchange information. Each of the reader/writer and the RFID tag includes an RFID IC chip for processing a signal and an antenna for transmitting and receiving a radio signal. Predetermined information is transmitted between the antennas of the reader/writer and the RFID tag via a magnetic field or an electromagnetic field.

For example, FeliCa (registered trademark) that applies an RFID system to information communication terminals such as mobile telephones has been recently used. In Felica, a terminal itself is sometimes used as a reader/writer or an RFID tag. On the other hand, since communication terminals decrease in size and increase in functionality, there is not sufficient space for an antenna in the casings of the communication terminals. In order to solve this problem, for example, a configuration disclosed in WO2010/122685/A1 is sometimes used. In this configuration, a small coil conductor is connected to an RFID IC chip and a radio signal is transmitted from a conductive layer that is adjacent to the coil conductor and has a large area. The conductive layer functions as a radiation element (booster antenna) and is magnetically coupled to the coil conductor via an opening of the conductive layer. With this configuration, since a thin metal film can be used as the conductive layer, the conductive layer can be formed in narrow space between a printed circuit board and a terminal casing.

As the conductive layer (booster antenna), a metal film may be prepared as described above. Alternatively, in a case where the terminal casing is a metal casing, the metal casing itself may be used as the booster antenna. In this case, it is desired that the metal casing be connected to the ground of a circuit in the terminal casing. More specifically, it is desired that the metal casing be connected to the ground of a printed circuit board in the terminal casing. In the terminal casing, for example, a power supply circuit and a high-frequency signal processing circuit are formed. By using the metal casing as the ground, a ground potential in the terminal casing can become more stable. As a result, the operations of various circuits can become more stable.

However, in a case where the ground of the printed circuit board and the metal casing are connected, an antenna characteristic may be deteriorated in accordance with a connection method.

SUMMARY OF THE INVENTION

Preferred embodiments of the present invention provide an antenna apparatus capable of maintaining a radiation characteristic of a booster antenna connected to a ground conductor and a communication terminal including the antenna apparatus.

An antenna apparatus according to a preferred embodiment of the present invention includes a feeding coil connected to a feeding circuit, a booster antenna that includes a conductor at which a conductor aperture and a slit to connect the conductor aperture and an outer edge are provided and includes an area larger than a footprint of the feeding coil, a ground conductor facing the booster antenna, and a ground connection conductor that connects the booster antenna to the ground conductor. The conductor aperture is located at an offset position near the outer edge of the conductor. The ground connection conductor is disposed at a position on either side of the slit outside an area in which a current density of an induced current flowing through the booster antenna is in a range from a maximum value to about 80% of the maximum value or a position on one side of the slit in the area.

With this configuration, since a circuitous path for a current is not provided in an area (high current density area) in which the current density is in the range from a maximum value to about 80% of the maximum value, a loss becomes small and the deterioration of an antenna characteristic due to the connection of a booster antenna to the ground rarely occurs.

In order to further reduce a loss, the ground connection conductor is preferably disposed at a position on either side of the slit outside an area in which a current density of an induced current flowing through the booster antenna is in a range from a maximum value to about 50% of the maximum value or a position on one side of the slit in the area.

With this configuration, since a circuitous path for a current is not provided in an area (relatively high current density area) in which the current density is in the range from a maximum value to about 50% of the maximum value, a loss becomes smaller and the deterioration of an antenna characteristic due to the connection of a booster antenna to the ground rarely occurs.

The ground conductor is preferably a ground conductor pattern provided at a printed circuit board in a casing of an apparatus in which the antenna apparatus is embedded. The booster antenna is preferably a metal layer provided at the casing or a metal plate that is a portion of the casing.

With this configuration, the booster antenna can be electrically connected to the ground conductor and the need to newly dispose a booster antenna is eliminated.

The ground conductor is preferably a ground conductor pattern provided at a printed circuit board in a casing of an apparatus in which the antenna apparatus is embedded. The booster antenna is preferably a metal plate or a metal case that is disposed in the casing and shields a circuit located on the printed circuit board.

With this configuration, the booster antenna can be electrically connected to the ground conductor and the need to newly dispose a booster antenna is eliminated.

The slit preferably connects the conductor aperture and the outer edge of the conductor at a position at which the conductor aperture and the outer edge of the conductor are in closest proximity to each other.

With this configuration, the length of a path for a current that does not contribute radiation, that is, a current passing through the periphery of the slit and the booster antenna, is significantly reduced. This leads to the reduction in a loss.

A communication terminal according to a preferred embodiment of the present invention includes a feeding circuit, a feeding coil connected to the feeding circuit, a booster antenna that includes a conductor at which a conductor aperture and a slit to connect the conductor aperture and an outer edge are provided and includes an area larger than a footprint of the feeding coil, a ground conductor facing the booster antenna, and a ground connection conductor that connects the booster antenna to the ground conductor. The conductor aperture is located at an offset position near the outer edge of the conductor. The ground connection conductor is disposed at a position on either side of the slit outside an area in which a current density of an induced current flowing through the booster antenna is in a range from a maximum value to about 80% of the maximum value or a position on one side of the slit in the area.

According to a preferred embodiment of the present invention, since a circuitous path for a current is not provided in an area in which the density of a current flowing through a booster antenna is high, a loss becomes small and the deterioration of an antenna characteristic due to the connection of the booster antenna to the ground rarely occurs. As a result, an antenna apparatus with a long communication distance can be obtained. Furthermore, a directivity toward a high current density area can be achieved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

An antenna apparatus according to the first preferred embodiment of the present invention and a communication terminal according to the first preferred embodiment will be described with reference to the accompanying drawings.

Figure 1A:
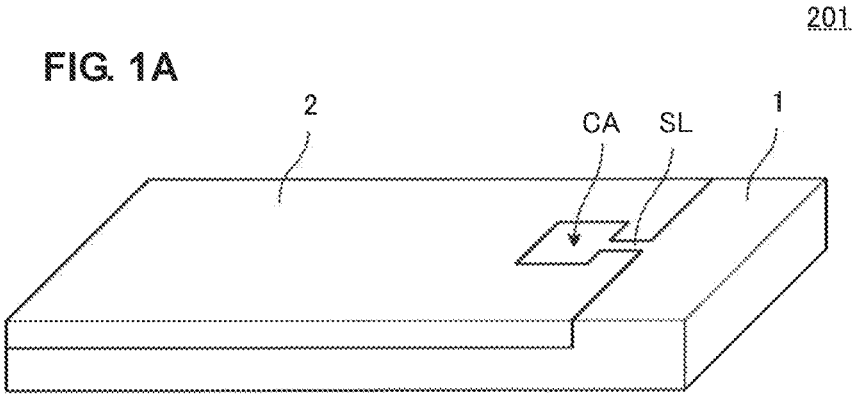
FIG. 1A is a schematic perspective view of a communication terminal including an antenna apparatus according to a first preferred embodiment of the present invention when viewed from the back surface of the communication terminal.
Figure 1B:
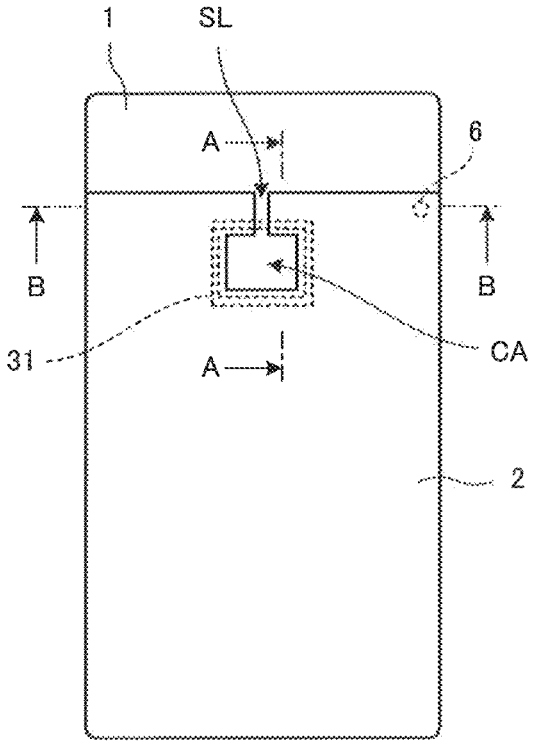
FIG. 1B is a back view of the communication terminal including an antenna apparatus according to the first preferred embodiment of the present invention.

FIG. 1A is a schematic perspective view of a communication terminal 201 including an antenna apparatus according to the first preferred embodiment when viewed from the back surface of the communication terminal 201. FIG. 1B is a back view of the communication terminal including an antenna apparatus according to the first preferred embodiment. The communication terminal 201 is, for example, a mobile terminal with a camera. The communication terminal 201 includes a casing 1 made of a resin and a metal cover 2. The metal cover 2 includes a conductor aperture CA and a slit SL that connects the conductor aperture CA and an outer edge. The conductor aperture CA is located at a position (offset position) near the outer edge of the metal cover 2. In this example, since the metal cover 2 is substantially rectangular in shape, the conductor aperture CA is located at a position near one side of the metal cover 2.

Inside the metal cover 2 of the communication terminal 201, a feeding coil module is disposed so that a feeding coil 31 is arranged along the conductor aperture CA. The area of the metal cover 2 is larger than the footprint of the feeding coil 31, and functions as a booster antenna as will be described later. A surface on which the metal cover 2 is disposed (the back surface of the communication terminal) is directed toward an antenna of a reader/writer that is a communication partner.

Inside the casing 1, a feeding coil module is disposed so that it partly overlaps the conductor aperture CA. That is, a lens of a camera module and the conductor aperture CA are brought into alignment with each other so that the lens is externally exposed at the opening of the casing. Referring to FIGS. 1A and 1B, the illustration of the camera module is omitted.

Figure 2A:
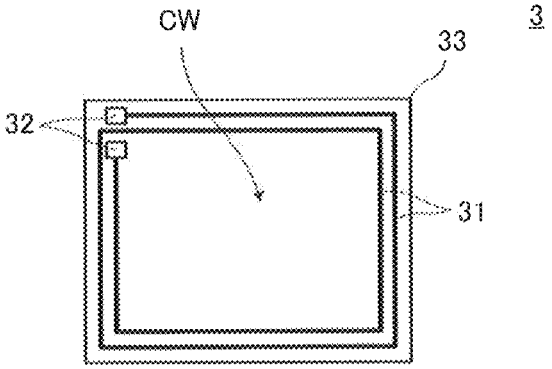
FIG. 2A is a plan view of a feeding coil module.
Figure 2B:
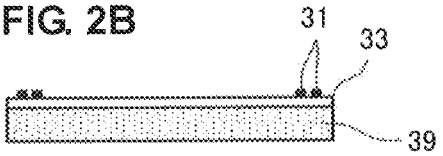
FIG. 2B is an elevational view of the feeding coil module.

FIG. 2A is a plan view of a feeding coil module 3. FIG. 2B is an elevational view of the feeding coil module 3. The feeding coil module 3 includes a substantially rectangular plate-like flexible substrate 33 and a substantially rectangular plate-like magnetic sheet 39. On the flexible substrate 33, the spiral feeding coil 31 including a coil window CW at a winding center and a connection portion 32 used for connection to an external circuit are provided. The magnetic sheet 39 is, for example, a ferrite sheet.

A capacitor to be connected in parallel to the connection portion 32 is provided at a circuit board. A resonant frequency is determined in accordance with an inductance determined by the feeding coil 31 and the magnetic sheet 39 in the feeding coil module 3 and the capacitance of the capacitor. For example, in a case where the feeding coil module 3 is used in NFC (Near Field Communication: short-range communication) such as Felica (registered trademark) and the HF band having a center frequency of approximately 13.56 MHz is used, the resonant frequency is set to approximately 13.56 MHz.

The number of windings (turns) of the feeding coil 31 is determined in accordance with a required inductance. In a case where the number of windings of the feeding coil 31 is one, the feeding coil 31 is a loop feeding coil.

Figure 3A:
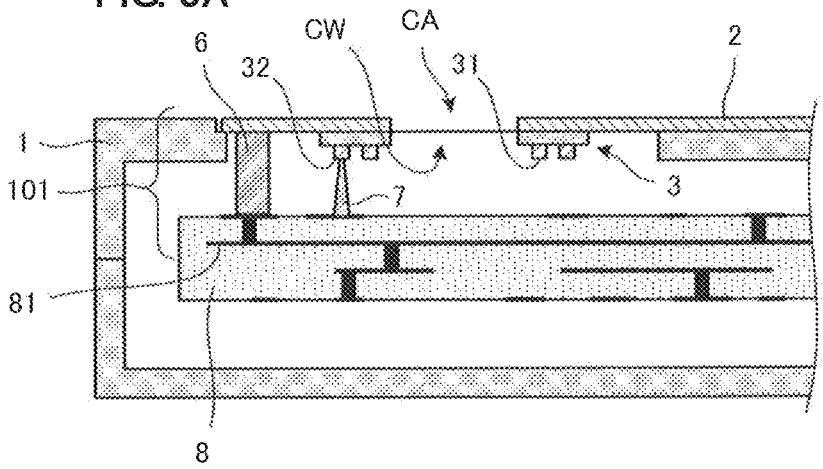
FIG. 3A is a cross-sectional view taken along the line A-A of FIG. 1B.
Figure 3B:
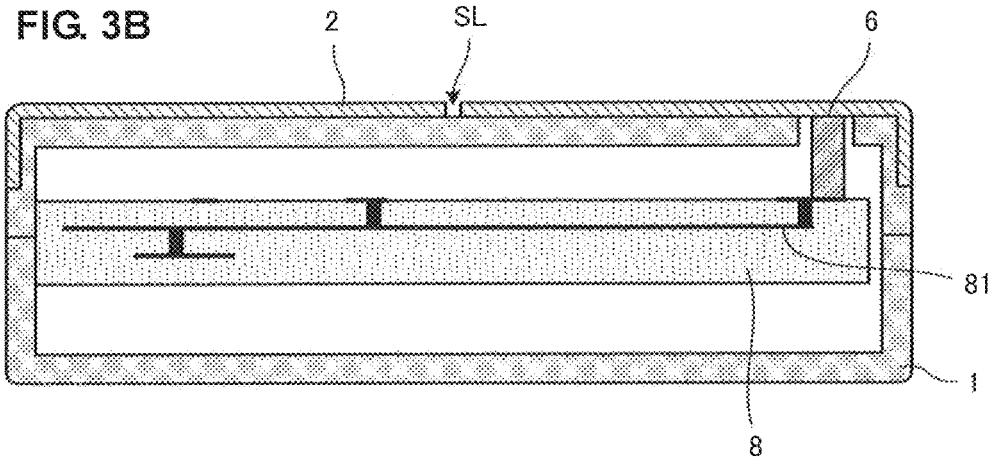
FIG. 3B is a cross-sectional view taken along the line B-B of FIG. 1B.

FIG. 3A is a cross-sectional view taken along the line A-A of FIG. 1B. FIG. 3B is a cross-sectional view taken along the line B-B of FIG. 1B.

As illustrated in FIG. 3A, the feeding coil module 3 is disposed on the undersurface of the metal cover 2. A printed circuit board 8 is included in the casing 1. At the printed circuit board 8, a ground conductor 81, a feeding pin 7, and a ground connection conductor 6 are disposed. When the metal cover 2 at which the feeding coil module 3 is disposed is mounted on the casing 1, the feeding pin 7 is brought into contact with the connection portion (the connection portion 32 illustrated in FIG. 2A) of the feeding coil module 3 and is electrically connected thereto. In addition, the ground connection conductor 6 is brought into contact with the metal cover 2 and is electrically connected thereto. The feeding coil module 3, the metal cover 2, and the ground conductor 81 define an antenna apparatus 101.

Since the coil window CW and the conductor aperture CA at least partly overlap in plan view of the feeding coil 31, a magnetic flux to be linked to the feeding coil 31 and an antenna in a communication partner can circulate through the coil window CW and the conductor aperture CA. In particular, when the circumferences of the coil window CW and the conductor aperture CA almost overlap in plan view of the feeding coil 31, a magnetic field generated by the feeding coil 31 can be effectively emitted from the metal cover 2.

Figure 4A:
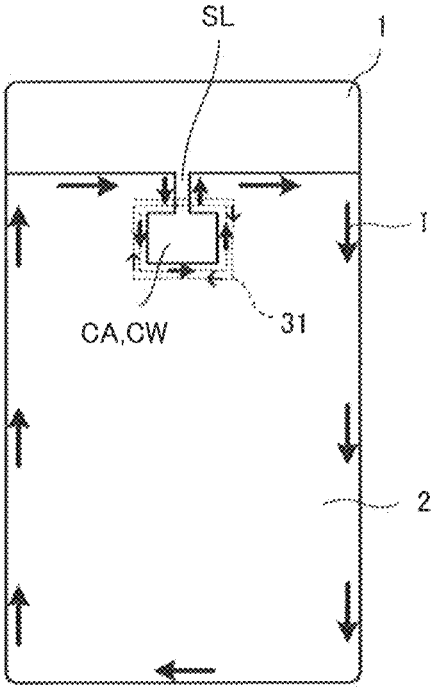
FIGS. 4A and 4B are diagrams illustrating examples of a current flowing through a feeding coil and a metal cover.
Figure 4B:
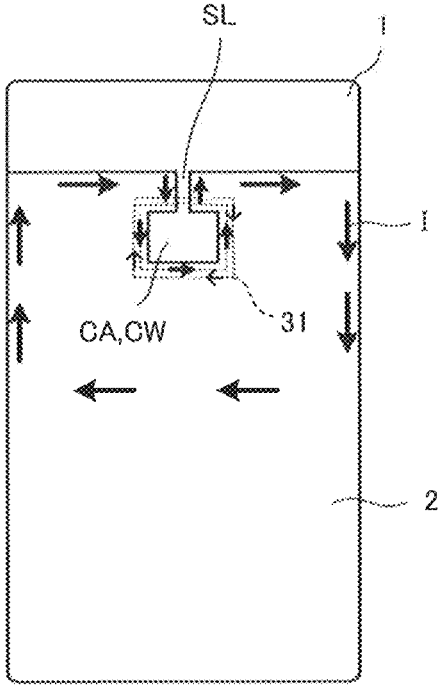

FIGS. 4A and 4B are diagrams illustrating examples of a current flowing through the feeding coil 31 and the metal cover 2. The circumferences of the coil window CW and the conductor aperture CA almost overlap on the same axis in plan view of the feeding coil 31 and the metal cover 2. With this structure, in plan view of the feeding coil 31, the feeding coil 31 can wholly overlap the metal cover 2. As a result, since all of magnetic fluxes generated by the feeding coil 31 are to be linked to the metal cover 2, a large current flows through the metal cover 2 in a direction opposite to the direction of a current passing through the feeding coil 31 so that these magnetic fluxes are blocked. A large current I, flowing around the conductor aperture CA, passes through the periphery of the slit SL, and flows along the periphery of the metal cover 2. As a result, a strong magnetic field is generated at the metal cover 2 and a communication range can be further increased. The loop of a magnetic flux flowing around the metal cover 2 via the conductor aperture CA and the coil window CW is effectively expanded. In a case where the metal cover 2 is relatively large, the density of the current I flowing along the outer edge of the metal cover 2 close to the feeding coil 31 and the conductor aperture CA may be higher than that of the current I flowing along the outer edge of the metal cover 2 apart from the feeding coil 31 and the conductor aperture CA as illustrated in FIG. 4B.

Figure 5:
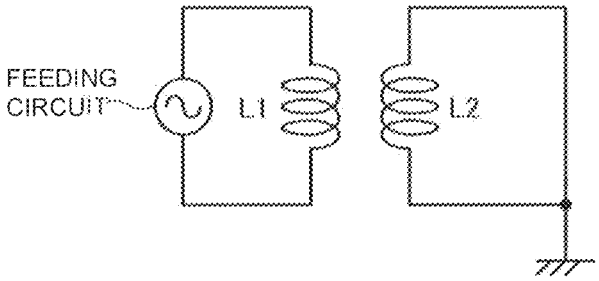
FIG. 5 is an equivalent circuit diagram of an antenna apparatus according to the first preferred embodiment of the present invention.

FIG. 5 is an equivalent circuit diagram of the antenna apparatus 101 according to the first preferred embodiment. Referring to FIG. 5, an inductor L1 corresponds to the feeding coil 31 and an inductor L2 corresponds to the metal cover 2 including the conductor aperture CA and the slit SL.

One of the unique features of the present preferred embodiment of the present invention is that a ground connection conductor is disposed on either side of the slit SL outside a high current density area where the current density of an induced current flowing through the metal cover 2 (booster antenna) is in the range from its maximum value to about 80% (or about 50%) of the maximum value or on one side of the slit SL in the high current density area. First, the high current density area will be simply specified on the basis of a structure.

Figure 6:
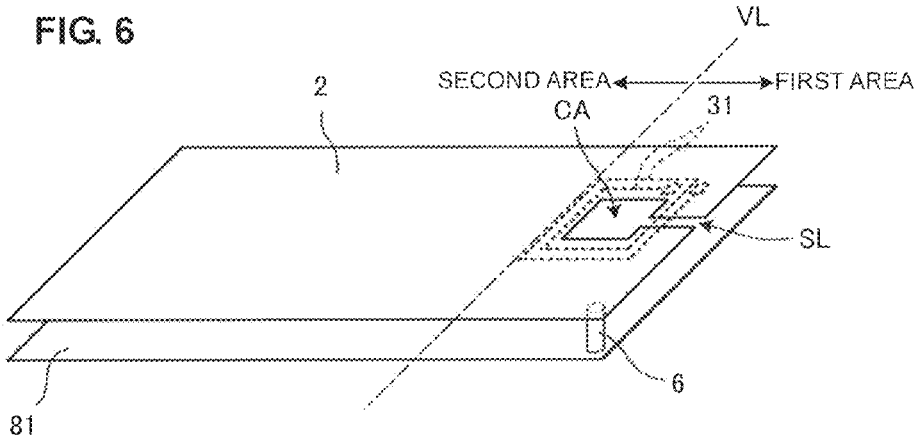
FIG. 6 is a diagram illustrating two areas used to determine a position at which a ground connection conductor is provided.

FIG. 6 is a diagram illustrating two areas used to determine a position at which the ground connection conductor 6 is located. In order to determine a position at which the ground connection conductor 6 is located, the metal cover 2 is divided into a first area and a second area. The first area includes the conductor aperture CA, the slit SL, and the feeding coil 31 in plan view and is specified by a substantially straight line parallel to a portion of the outer edge of the metal cover 2 connected to the slit SL. The second area is an area excluding the first area. The first area is the high current density area.

The ground connection conductor 6 to connect the metal cover 2 to the ground conductor 81 is disposed on one side of the slit SL in the first area.

Figure 7A:
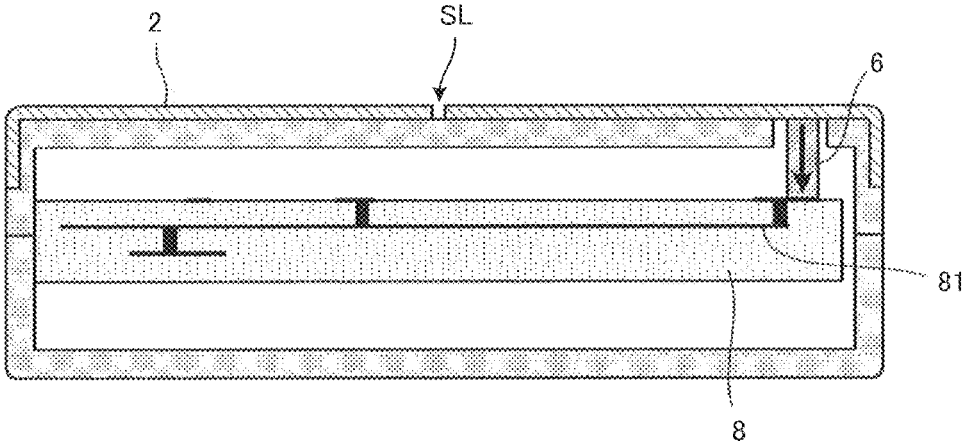
FIG. 7A is a cross-sectional view illustrating an exemplary path of a current flowing through the ground connection conductor in the antenna apparatus according to the first preferred embodiment of the present invention.
Figure 7B:
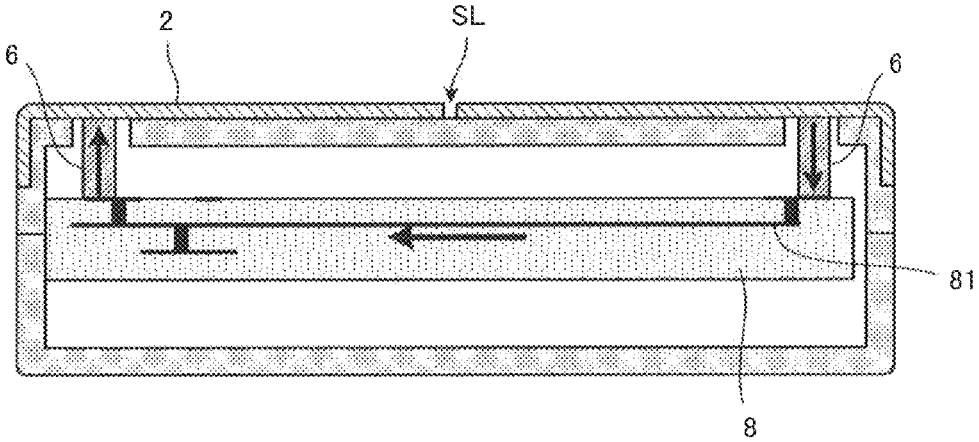
FIG. 7B is a diagram illustrating an exemplary path of a current flowing through the ground connection conductor in an antenna apparatus that is a comparative example.

FIG. 7A is a cross-sectional view that is taken along the line B-B of FIG. 1B and illustrates an exemplary path of a current flowing through the ground connection conductor 6 in the antenna apparatus 101 according to the first preferred embodiment. FIG. 7B is a diagram illustrating an exemplary path of a current flowing through the ground connection conductor 6 in an antenna apparatus that is a comparative example. In this antenna apparatus that is a comparative example, the ground connection conductor 6 is disposed on either side of the slit SL. In the antenna apparatus illustrated in FIG. 7B, a portion of a current flowing through the metal cover 2 goes to the ground connection conductors 6 and the ground conductor 81. Since a circuitous path is generated, a current flowing along the conductor aperture CA is reduced and the operational effect of the metal cover 2 functioning as a booster antenna is reduced. In the antenna apparatus illustrated in FIG. 7A, since the bypass is not generated, the operational effect of the metal cover 2 functioning as a booster antenna can be maintained while the metal cover 2 is electrically connected to the ground of a circuit.

Figure 8:
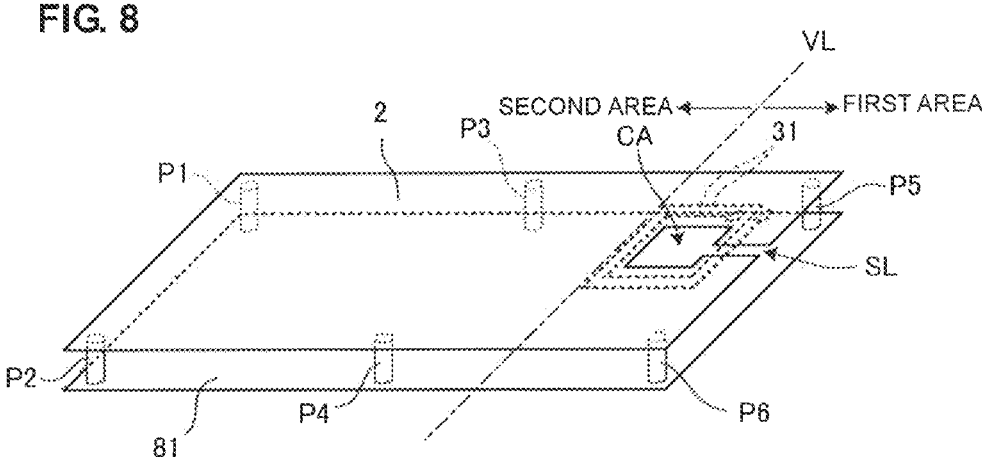
FIG. 8 is a perspective view illustrating an exemplary position of a ground connection conductor when viewed from a printed circuit board.

An antenna characteristic that varies in accordance with a point of connection between the metal cover 2 and a ground conductor, that is, a position at which a ground connection conductor is located, and the number of the ground connection conductors will be described. FIG. 8 is a perspective view illustrating an exemplary position of a ground connection conductor. In a case where the metal cover 2 is connected to the ground conductor 81 of a printed circuit board at the positions of ground connection conductors P1 to P6, antenna radiation efficiency is changed in accordance with the positions of the ground connection conductors and the number of the ground connection conductors. The ground connection conductors P1 to P4 are in the second area. The ground connection conductors P5 and P6 are on both sides of the slit SL in the first area.

Figure 9:
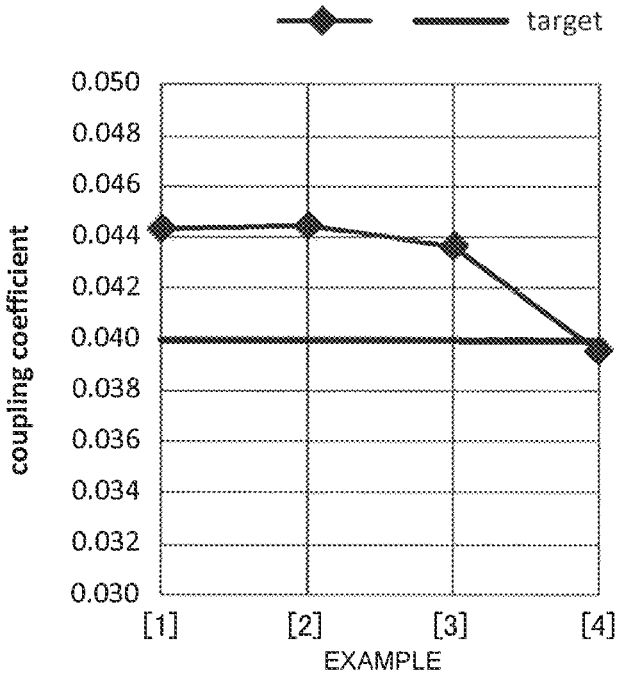
FIG. 9 is a graph illustrating the relationship between the number of the ground connection conductors and an antenna coupling coefficient.

FIG. 9 is a graph illustrating the relationship between the number of the ground connection conductors and an antenna coupling coefficient. The horizontal axis represents the number of an example of experiment. In an example [1], no ground connection conductor was disposed. In an example [2], the ground connection conductors P1 and P2 illustrated in FIG. 8 were disposed. In an example [3], the ground connection conductors P1, P2, P3, and P4 illustrated in FIG. 8 were disposed. In an example [4], all of the ground connection conductors P1 o P6 illustrated in FIG. 8 were disposed. The vertical axis represents the coefficient of the coupling between an antenna apparatus and an antenna in a reader/writer. The metal cover 2 had the size of approximately 50 mm×approximately 80 mm, and the feeding coil 31 had the size of approximately 15 mm×approximately 15 mm×approximately 0.35 mm, for example. The antenna in the reader/writer was a loop antenna having the diameter of approximately 80 mm and a plurality of turns, for example.

When the ground connection conductors were disposed in only the second area, the coupling coefficient was approximately 0.044, for example, as illustrated in FIG. 9. When the ground connection conductors were disposed in the first area, the coupling coefficient was below approximately 0.040, for example. The maximum possible communication range between an antenna apparatus and an antenna in a reader/writer when the coupling coefficient is approximately 0.040 is approximately 40 mm, for example. Accordingly, in a case where all of the ground connection conductors P1 to P6 are disposed, the maximum possible communication range between an antenna apparatus and an antenna in a reader/writer becomes less than approximately 40 mm, for example.

Figure 10:
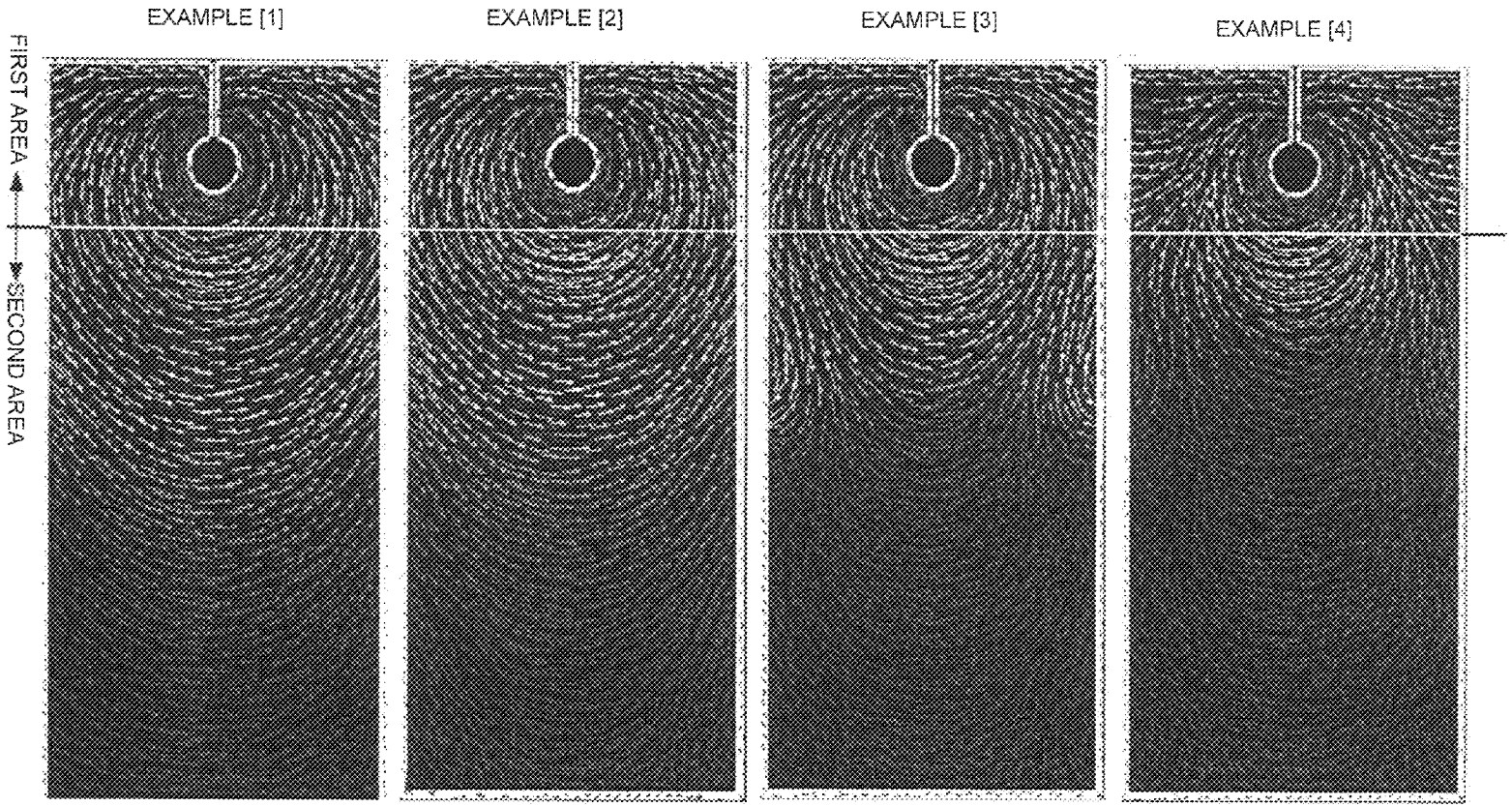
FIG. 10 is a diagram illustrating the altered distribution of density of a current flowing through the metal cover which is changed in accordance with the number of the ground connection conductors.
Figure 11:
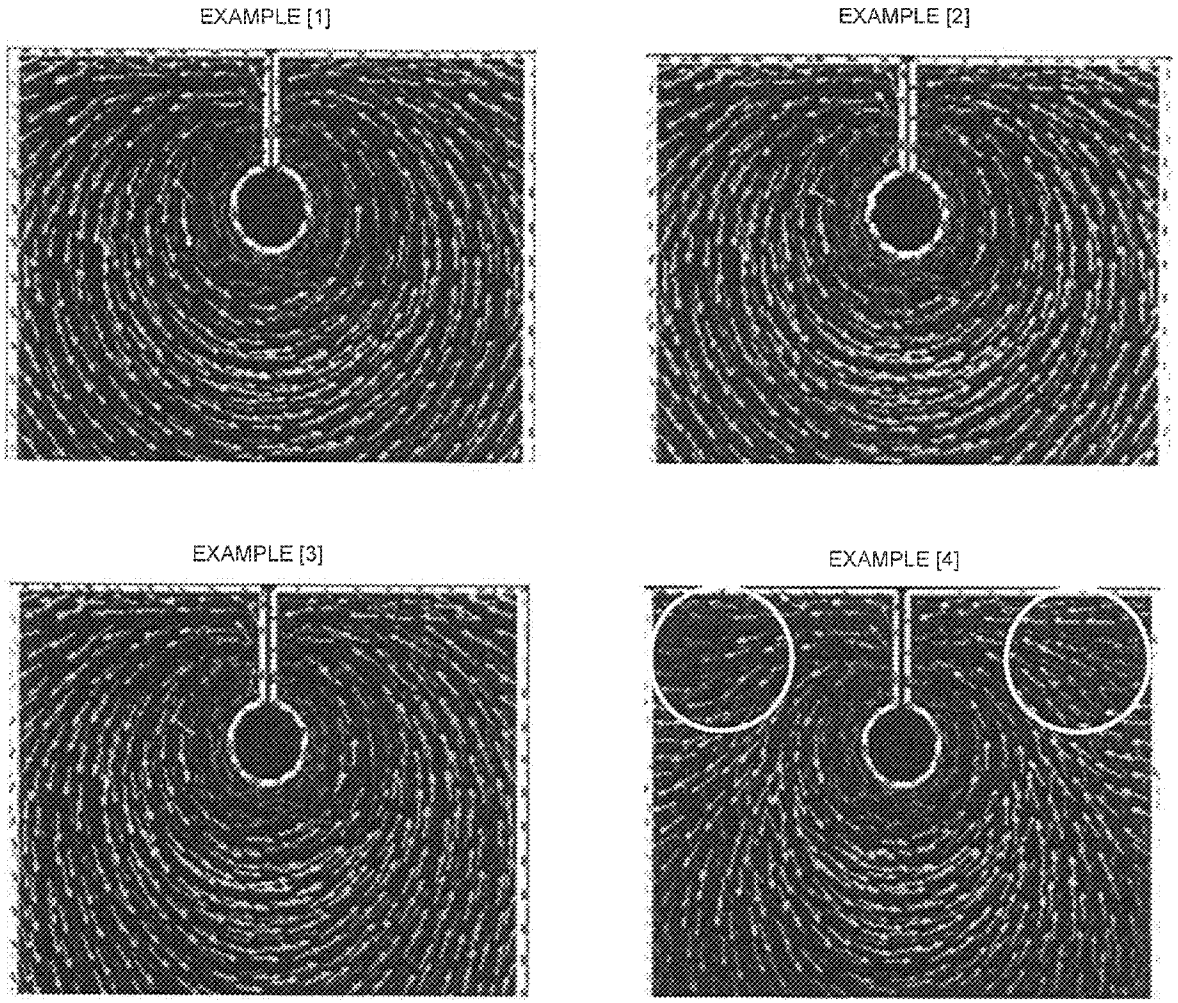
FIG. 11 is a partially enlarged view of FIG. 10.

FIG. 10 is a diagram illustrating the altered distribution of density of a current flowing through the metal cover 2 which is changed in accordance with the number of the ground connection conductors. FIG. 11 is a partially enlarged view of FIG. 10.

In the examples [1], [2], and [3], substantially the same distribution of density of a current flowing through the metal cover 2 was obtained. In the example [4], a current flowing through a ground conductor was generated as illustrated in circles in FIG. 11. That is, as illustrated in FIG. 7B, a bypass through the ground connection conductors disposed on both sides of the slit and the ground conductor was generated.

Next, the change in antenna characteristic will be described focusing not on the number of the ground connection conductors but on the positions of the ground connection conductors.

Figure 12A:
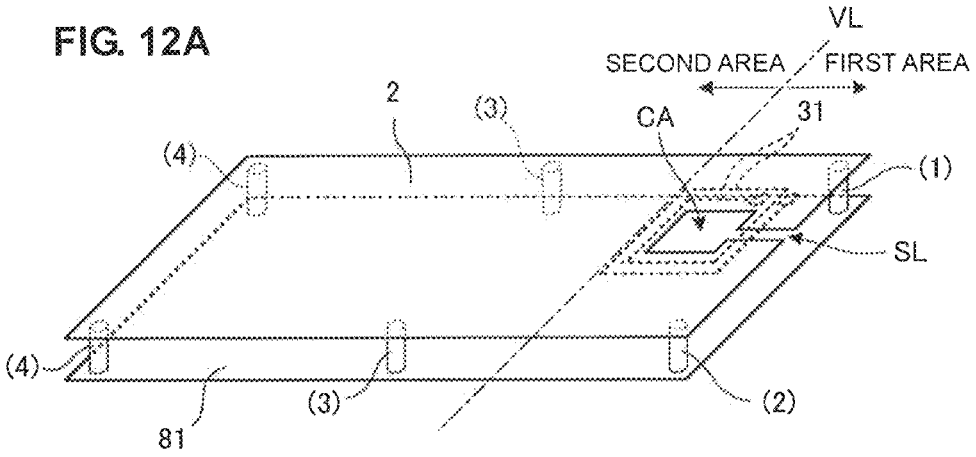
FIGS. 12A and 12B are perspective views illustrating an exemplary position of the ground connection conductor when viewed from the printed circuit board.
Figure 12B:
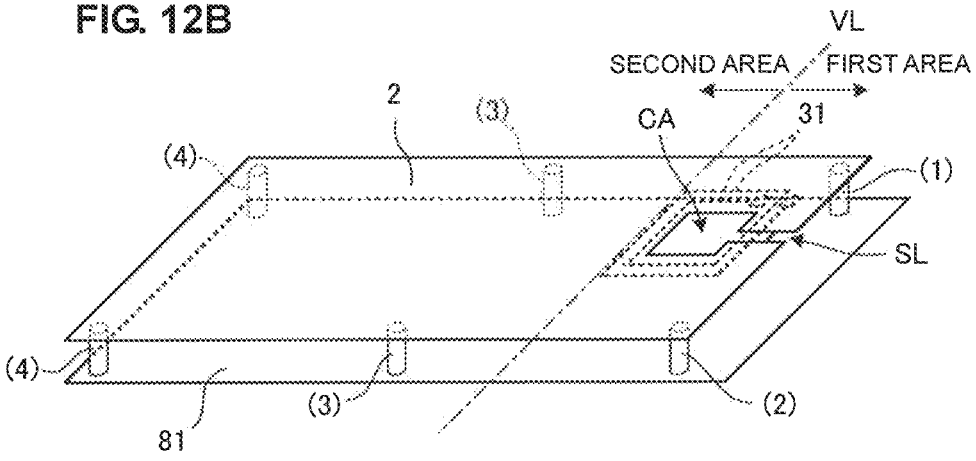

FIGS. 12A and 12B are perspective views illustrating an exemplary position of the ground connection conductor. The ground connection conductor to connect the metal cover 2 to the ground conductor 81 of a printed circuit board is preferably disposed at six positions. The sizes of the metal cover 2 and the feeding coil 31 in the antenna apparatus illustrated in FIG. 12A and the size of an antenna in a reader/writer are the same as those of the metal cover 2 and the feeding coil 31 in the antenna apparatus illustrated in FIG. 8 and that of an antenna in a reader/writer described with reference to FIG. 8, respectively. An antenna apparatus illustrated in FIG. 12B includes the ground conductor 81 whose length in the longitudinal direction is longer than that of the ground conductor 81 illustrated in FIG. 12A by approximately 5 mm, for example.

Table 1 indicates the relationship between each of examples [5] to [10] and the presence of the ground connection conductor at positions (1) to (4) illustrated in FIGS. 12A and 12B.

TABLE 1

| | (1) | (2) | (3) | (4) |
|---|---|---|---|---|
| Example 5 | X | X | X | X |
| Example 6 | ○ | X | X | X |
| Example 7 | X | ○ | X | X |
| Example 8 | ○ | ○ | X | X |
| Example 9 | ○ | ○ | ○ | X |
| Example 10 | ○ | ○ | ○ | ○ |

○: With ground connection conductor
X: With no ground connection conductor

Figure 13A:
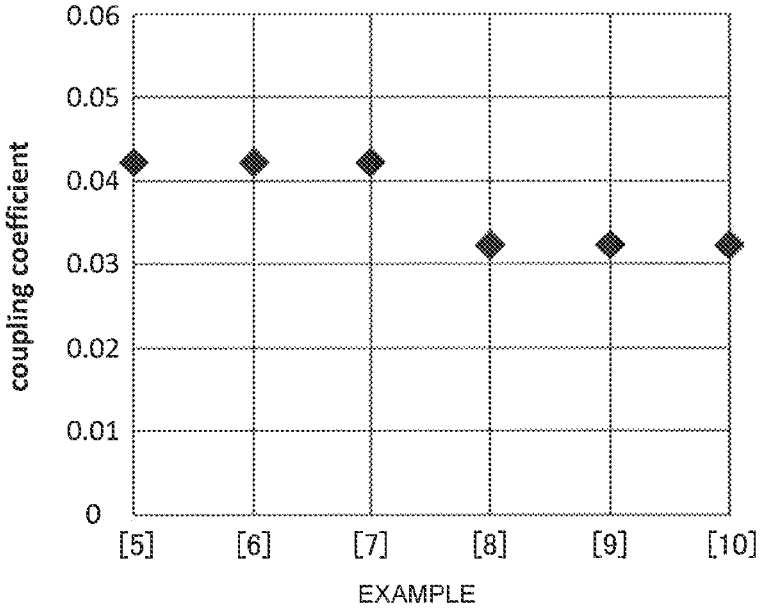
FIG. 13A is a diagram illustrating the characteristic of an antenna apparatus illustrated in FIG. 12A.
Figure 13B:
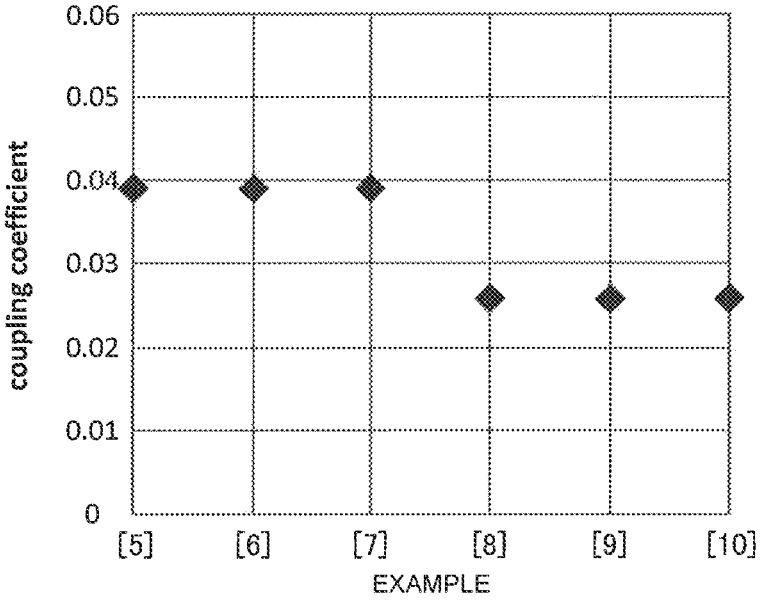
FIG. 13B is a diagram illustrating the characteristic of an antenna apparatus illustrated in FIG. 12B.

FIG. 13A is a diagram illustrating the characteristic of the antenna apparatus illustrated in FIG. 12A. FIG. 13B is a diagram illustrating the characteristic of the antenna apparatus illustrated in FIG. 12B. As is apparent from these drawings, a coupling coefficient was changed between a set of the examples [5], [6], and [7] and a set of the examples [8], [9], and [10] in a step form. That is, when the ground connection conductor was disposed at one of the positions (1) and (2) illustrated in FIGS. 12A and 12B, there was no change in the coupling coefficient and the effect of the ground connection conductor did not appear. On the other hand, when the ground connection conductor was disposed at both the positions (1) and (2), the coupling coefficient was reduced.

As is apparent from the comparison between the FIGS. 13A and 13B, the extension of the ground conductor 81 from the metal cover 2 in a direction in which the slit is formed reduced the coupling coefficient. Accordingly, it is desired that the ground conductor 81 not protrude from the side at which the slit is located.

Second Preferred Embodiment

Figure 14A:
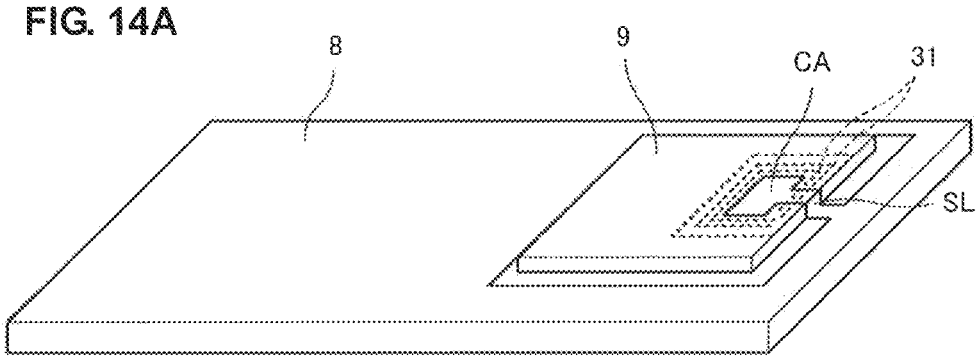
FIG. 14A is a schematic perspective view of a communication terminal including an antenna apparatus according to a second preferred embodiment of the present invention when viewed from the back surface of the communication terminal.
Figure 14B:
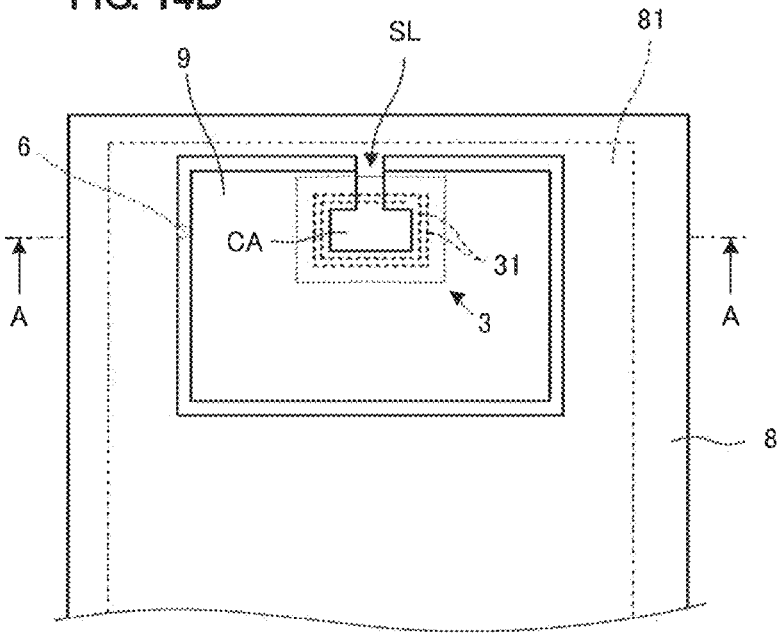
FIG. 14B is a back view of the communication terminal including an antenna apparatus according to the second preferred embodiment of the present invention.

FIG. 14A is a schematic perspective view of a communication terminal 202 including an antenna apparatus according to the second preferred embodiment of the present invention when viewed from the back surface of the communication terminal 202. FIG. 14B is a back view of the communication terminal including an antenna apparatus according to the second preferred embodiment. The communication terminal 202 includes a metal case 9 that shields a high-frequency circuit formed on the printed circuit board 8 in a casing. The metal case 9 includes the conductor aperture CA and the slit SL that connects the conductor aperture CA and an outer edge. The conductor aperture CA is located at a position (offset position) near the outer edge of the metal case 9. In this example, since the metal case 9 is substantially rectangular in shape, the conductor aperture CA is located at a position near one side of the metal case 9.

On an inner surface of the metal case 9, the feeding coil module 3 is disposed so that the feeding coil 31 is arranged along the conductor aperture CA. Like in the first preferred embodiment, in the second preferred embodiment, the feeding coil module 3 includes a flexible substrate on which the feeding coil 31 is formed and a magnetic sheet (ferrite sheet). The area of the metal case 9 is larger than the footprint of the feeding coil 31 in the feeding coil module, and functions as a booster antenna. A surface on which the metal case 9 is disposed (the back surface of the communication terminal) is directed toward an antenna of a reader/writer that is a communication partner.

Figure 15:
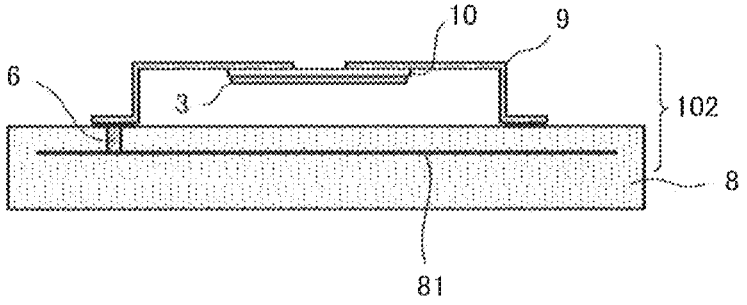
FIG. 15 is a cross-sectional view taken along the line A-A of FIG. 14B.

FIG. 15 is a cross-sectional view taken along the line A-A of FIG. 14B. The feeding coil module 3 is disposed on the undersurface of the metal case 9 via an adhesive layer 10. At the printed circuit board 8, the ground conductor 81 and the ground connection conductor 6 are disposed. When the metal case 9 at which the feeding coil module 3 is disposed is mounted on the printed circuit board 8, the ground connection conductor 6 is brought into contact with the metal case 9 and is electrically connected thereto. The feeding coil module 3 is connected to the printed circuit board 8 via, for example, a feeding pin (not illustrated).

Thus, the metal case 9 on the printed circuit board 8 in a casing can be used as a booster antenna. When the same number of the ground connection conductors 6 are disposed at the same positions as the first preferred embodiment, an effect similar to that obtained in the first preferred embodiment can be obtained.

Third Preferred Embodiment

In the above-described preferred embodiments, the high current density area preferably is simply specified on the basis of a structure. That is, the first area, which includes the conductor aperture, the slit, and the feeding coil in plan view and is specified by a substantially straight line parallel to a portion of the outer edge of the metal cover connected to the slit, is defined as the high current density area. However, in this case, the constraint may be avoided. For example, the first area illustrated in FIG. 8 may include a portion in which the current density of an induced current is less than approximately 80% (or approximately 50%) of its maximum value. By disposing the ground connection conductor on either side of the slit SL in the first area while avoiding a portion in which the current density of an induced current is in the range from its maximum value to approximately 80% (or approximately 50%), the radiation characteristic of a booster antenna can be maintained.

In the third preferred embodiment, an example in which the high current density area is determined on the basis of the range of the current density of an induced current flowing through a booster antenna will be described. In order to show the reason why the high current density area is determined on the basis of the numerical range of a current density, the relationship between the numerical range of the high current density area and a communication range will be described.

FIGS. 16A to 16D are diagrams illustrating the direction of a current flowing through a booster antenna in an antenna apparatus according to the third preferred embodiment. Many small arrows indicate the directions of currents at corresponding positions, and bold arrows indicate the directions of general current flows.

Figures 16A, 16B, 16C, 16D:
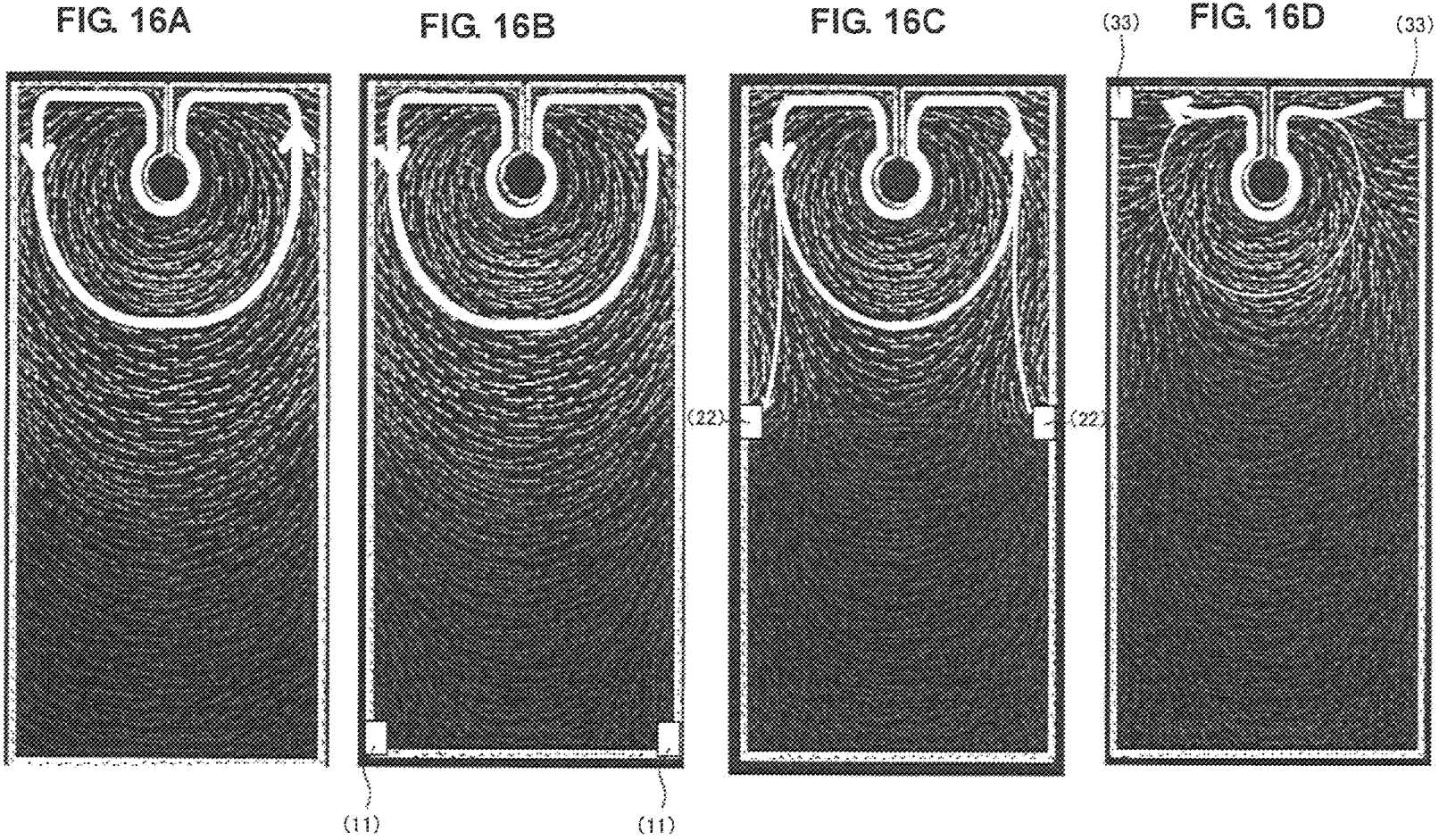
FIGS. 16A to 16D are diagrams illustrating the direction of a current flowing through a booster antenna in an antenna apparatus according to a third preferred embodiment of the present invention.

FIG. 16A illustrates a state when no ground connection conductor is disposed. FIG. 16B illustrates a state when the ground connection conductor is disposed at positions (11). FIG. 16C illustrates a state when the ground connection conductor is disposed at positions (22). FIG. 16D illustrates a state when the ground connection conductor is disposed at positions (33).

Each of a conductor aperture, a slit, and a feeding coil preferably has the same structure as that described in the first preferred embodiment. Non-limiting examples of calculation conditions for simulation are as follows.

The outer dimensions of the booster antenna: approximately 50 mm×approximately 80 mm The outer dimensions of the ground conductor: approximately 50 mm×approximately 80 mm The distance between the booster antenna and the ground conductor: approximately 5 mm (the booster antenna and the ground conductor overlap in plan view)

The size of the feeding coil: approximately 15 mm×approximately 15 mm

The distance between the end of the feeding coil and the end of the booster antenna: approximately 5 mm The width of the slit: approximately 1 mm The size of an opening of the booster antenna: ϕ approximately 3 mm As is apparent from FIG. 16A, in a case where no ground connection conductor is disposed, all of currents flow through the booster antenna. As is apparent from the comparison between FIGS. 16A and 16B, in a case where the ground connection conductor is disposed at the positions (11), substantially the same simulation result as that obtained in a case where no ground connection conductor is disposed is obtained. Accordingly, the reduction in the radiation characteristic of a booster antenna caused by the ground connection conductors does not occur. On the other hand, as is apparent from FIG. 16C, in a case where the ground connection conductor is disposed at the positions (22) at which a current density is relatively high, a current flows between two ground connection conductors and the amount of a current flowing through the booster antenna is reduced. As a result, the radiation characteristic of the booster antenna is reduced. As is apparent from FIG. 16D, in a case where the ground connection conductor is disposed at the positions (33) at which a current density is higher, a current flows between two ground connection conductors and the amount of a current flowing through the booster antenna is further reduced. As a result, the radiation characteristic of the booster antenna is further reduced.

Accordingly, in a case where a plurality of ground connection conductors are disposed for a booster antenna, it is important to determine an area in which the ground connection conductors are disposed on the basis of the value of a current density.

Figure 17:
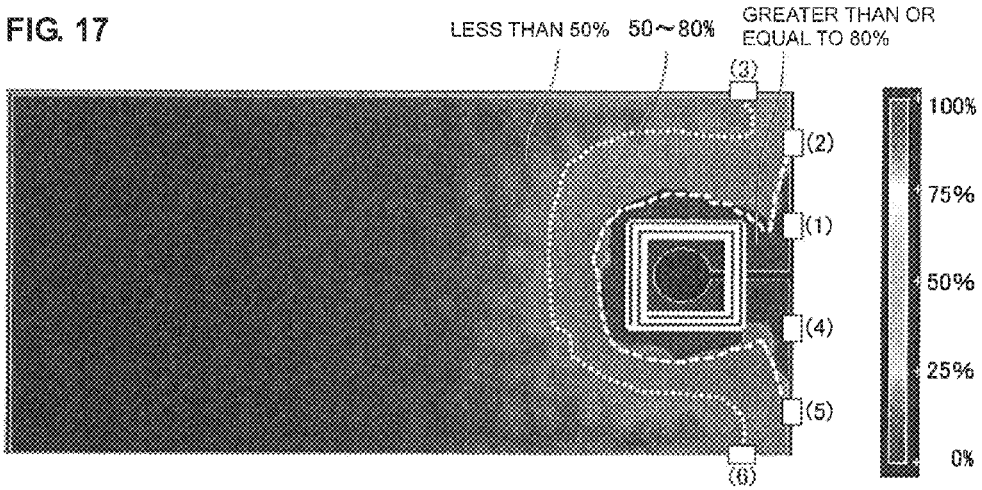
FIG. 17 is a diagram illustrating the altered distribution of density of a current flowing through a booster antenna (metal cover) in an antenna apparatus according to the third preferred embodiment of the present invention.

FIG. 17 is a diagram illustrating the altered distribution of density of a current flowing through a booster antenna (metal cover) in an antenna apparatus according to the third preferred embodiment. The distribution of a current density is represented by the pattern of light and dark. There are three areas, an area in which a current density is approximately 80% or greater of its maximum value (approximately 100%), an area in which a current density is less than approximately 50% of its maximum value, and an area in which a current density is in the range from approximately 50% to a value less than approximately 80%. A boundary between areas is represented by a broken line. Referring to FIG. 17, (1) to (6) indicate positions at which the ground connection conductor is disposed.

Figure 18:
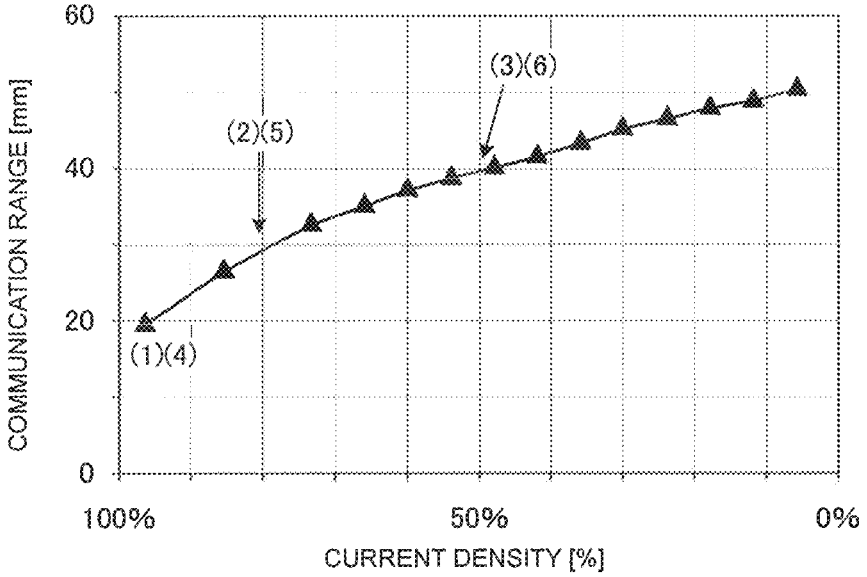
FIG. 18 is a graph illustrating the relationship between the density (specified as a percentage of the maximum current density) of a current flowing through a booster antenna and a communication range (the maximum possible communication range) in an antenna apparatus according to the third preferred embodiment of the present invention.

FIG. 18 is a graph illustrating the relationship between a current density (specified as a percentage with approximately 100% being the maximum value of a current density [A/m]) and a communication range (the maximum possible communication range) [mm]. A vertical axis represents the maximum possible communication range when the ground connection conductor is disposed at positions (1) and (4), (2) and (5), or (3) and (6) on both sides of the slit. A current density at the positions (1) and (4) is approximately 97% of its maximum value, for example. In a case where the ground connection conductor is disposed at these positions at which the current density is high, the radiation characteristic of a booster antenna is reduced and the maximum possible communication range becomes approximately 20 mm, for example. A current density at the positions (2) and (5) is approximately 80% of its maximum value, for example. In a case where the ground connection conductor is disposed at these positions, the maximum possible communication range of approximately 30 mm, for example, can be achieved. A current density at the positions (3) and (6) is approximately 50% of its maximum value, for example. In a case where the ground connection conductor is disposed at these positions at which the current density is low, the maximum possible communication range of approximately 40 mm, for example, which is a sufficient communication range, can be achieved.

The reasons why the above-described results are obtained are as follows. In a case where the ground connection conductor is disposed in the area in which the value of a current density is equal to or greater than about 80%, almost all of currents generated at the booster antenna by the feeding coil flow to the ground conductor via the ground connection conductors and the amount of current flowing through the booster antenna is markedly reduced. In a case where the ground connection conductor is disposed in the area in which the value of a current density is less than about 80%, a sufficient amount of current flows through the booster antenna. Accordingly, the radiation effect of the booster antenna is increased and a communication range is increased. In a case where the ground connection conductor is disposed in the area in which the value of a current density is less than about 50%, the flow of a current to the ground conductor rarely occurs. Accordingly, the radiation effect of the booster antenna is further increased and a communication range is further increased.

Thus, in order to obtain the maximum possible communication range of approximately 30 mm, for example, in a case where the ground connection conductors are disposed on either side of the slit, the ground connection conductors are disposed outside the area in which the current density of an induced current flowing through the booster antenna is in the range from its maximum value to about 80% of the maximum value, for example. In order to obtain the maximum possible communication range of approximately 40 mm, for example, the ground connection conductors are disposed outside the area in which the current density of an induced current flowing through the booster antenna is in the range from its maximum value to 50% of the maximum value, for example.

The maximum possible communication range of approximately 40 mm, for example, is preferred in RFID communication. The maximum possible communication range equal to or wider than at least approximately 30 mm, for example, can be considered to be a practical level.

Fourth Preferred Embodiment

Figure 19:
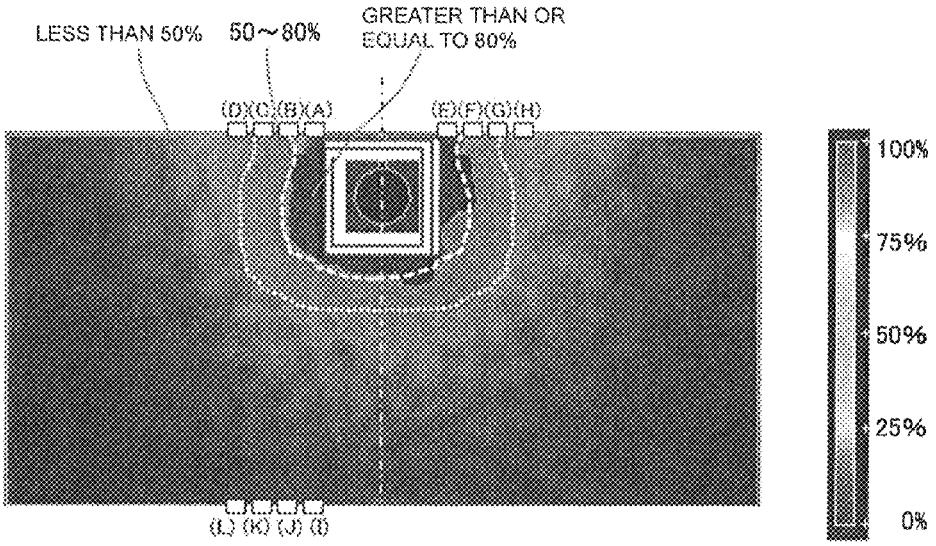
FIG. 19 is a diagram illustrating the altered distribution of density of a current flowing through a booster antenna (metal cover) in an antenna apparatus according to a fourth preferred embodiment of the present invention.

FIG. 19 is a diagram illustrating the altered distribution of density of a current flowing through a booster antenna (metal cover) in an antenna apparatus according to the fourth preferred embodiment of the present invention. The distribution of a current density is represented by the pattern of light and dark.

Each of a conductor aperture, a slit, and a feeding coil preferably has the same structure as that described in the first preferred embodiment. Non-limiting examples of calculation conditions for simulation are as follows.

The outer dimensions of the booster antenna:

approximately 50 mm×approximately 100 mm

The outer dimensions of the ground conductor:

approximately 50 mm×approximately 100 mm

The distance between the booster antenna and the ground conductor: approximately 5 mm (the booster antenna and the ground conductor overlap in plan view)

The size of the feeding coil: approximately 15 mm×approximately 15 mm

The distance between the end of the feeding coil and the end of the booster antenna: approximately 1 mm The width of the slit: approximately 1 mm The size of an opening of the booster antenna: ϕ approximately 3 mm Referring to FIG. 19, there are three areas, an area in which a current density is approximately 80% or greater of its maximum value (approximately 100%), an area in which a current density is less than approximately 50% of its maximum value, and an area in which a current density is in the range from approximately 50% and a value less than approximately 80%, for example. A boundary between areas is represented by a broken line. Referring to FIG. 19, (A) to (L) indicate positions at which the ground connection conductor is disposed.

Figure 20:
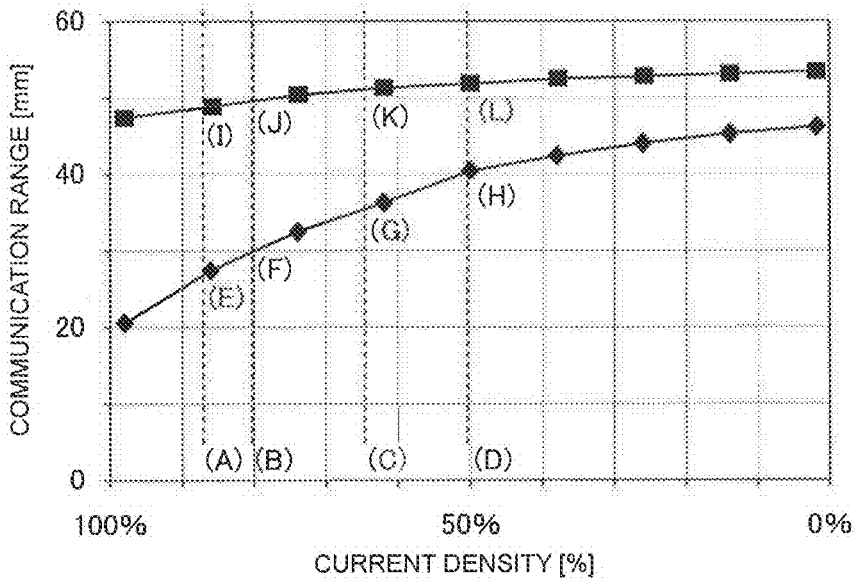
FIG. 20 is a graph illustrating the relationship between the density (specified as a percentage of the maximum current density) of a current flowing through a booster antenna and a communication range (the maximum possible communication range) in an antenna apparatus according to the fourth preferred embodiment of the present invention.

FIG. 20 is a graph illustrating the relationship between a current density (specified as a percentage with approximately 100% being the maximum value of a current density [A/m]) and a communication range (the maximum possible communication range) [mm]. Referring to the drawing, the ground connection conductor is disposed at the positions (A) and (E), (B) and (F), (C) and (G), or (D) and (H) that are equally spaced from the centerline on the left and right sides, and is disposed at the positions (A) and (I), (B) and (J), (C) and (K), or (D) and (L) that are spaced apart from each other along a line parallel to the centerline.

A current density at the positions (A) and (E) is approximately 86% of its maximum value, for example. In a case where the ground connection conductor is disposed at these positions at which the current density is high, the maximum possible communication range becomes approximately 27 mm, for example. A current density at the positions (B) and (F) is approximately 80% of its maximum value, for example. In a case where the ground connection conductor is disposed at these positions, the maximum possible communication range of approximately 30 mm, for example, can be achieved. A current density at the positions (C) and (G) is approximately 62% of its maximum value, for example. In a case where the ground connection conductor is disposed at these positions, the maximum possible communication range of approximately 36 mm can be achieved, for example. A current density at the positions (D) and (H) is approximately 50% of its maximum value, for example. In a case where the ground connection conductor is disposed at these positions at which the current density is low, the maximum possible communication range of approximately 40 mm, for example, which is a sufficient communication range, can be achieved.

In a case where the ground connection conductor is disposed at the positions (A) and (I), (B) and (J), (C) and (K), or (D) and (L) between which no slit is disposed, the ground connection conductors have little effect on the maximum possible communication range.

As is apparent from the comparison with the results illustrated in FIG. 18, regardless of whether the slit is in contact with the long side or the short side of the booster antenna, substantially the same relationship between the disposition of ground connection conductors in an area specified on the basis of a current density and the maximum possible communication range is obtained.

In the above-described preferred embodiments, a metal cover or a metal case is preferably used as a booster antenna. However, a metal layer located on the outer surface or the inner surface of a casing or a metal layer located in the casing may be used as a booster antenna. Alternatively, a metal plate (metal casing) that is a part of the casing may be used as a booster antenna. A metal case that shields a circuit located on a printed circuit board may be a metal plate.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna apparatus comprising:

a feeding coil connected to a feeding circuit;

a booster antenna that includes a rectangular conductor including a short side at which an aperture connected to the short side is located and a long side extending in a direction perpendicular or substantially perpendicular to the short side, the booster antenna extending over an area that is larger than a footprint of the feeding coil; and a ground conductor that faces the booster antenna; and a ground connection conductor that connects the booster antenna to the ground conductor; wherein the aperture is located at a position in an area of the rectangular conductor that is offset from a center of the long side of the rectangular conductor;

the rectangular conductor includes a first region and a second region that is separated from the first region by a straight line which is parallel or substantially parallel to the short side and which overlaps with an outer edge of the feeding coil, an entirety of the feeding coil and an entirety of aperture being disposed in the first region; and the ground connection conductor is disposed at a position in the second region of the rectangular conductor, or in the first region at a position spaced from the aperture.

2. The antenna apparatus according to claim 1, wherein the ground connection conductor is disposed outside a region in which a current density of an induced current flowing through the booster antenna is in a range from a maximum value to about 50% of the maximum value.

3. The antenna apparatus according to claim 1, wherein the ground conductor includes a ground conductor pattern located on a printed circuit board in a casing of an apparatus in which the antenna apparatus is embedded, and the booster antenna includes a metal layer located at the casing or a metal plate that is a portion of the casing.

4. The antenna apparatus according to claim 1, wherein the ground conductor includes a ground conductor pattern located on a printed circuit board in a casing of an apparatus in which the antenna apparatus is embedded, and the booster antenna includes a metal plate or a metal case that is disposed in the casing and configured to shield a circuit located on the printed circuit board.

5. The antenna apparatus according to claim 1, wherein the ground connection conductor is disposed only at positions on either side of the aperture outside an area in which a current density of an induced current flowing through the booster antenna is in a range from a maximum value to about 80% of the maximum value.

6. The antenna apparatus according to claim 1, wherein the ground connection conductor is disposed only at a position on one side of the aperture in an area in which a current density of an induced current flowing through the booster antenna is in a range from a maximum value to about 80% of the maximum value.

7. The antenna apparatus according to claim 1, wherein only one ground connection conductor is disposed at a position on one side of the aperture in an area in which a current density of an induced current flowing through the booster antenna is in a range from a maximum value to about 80% of the maximum value.

* * * * *